US011274897B2

(12) United States Patent
Liu et al.

(10) Patent No.: US 11,274,897 B2
(45) Date of Patent: Mar. 15, 2022

(54) MULTI-FUNCTION ADAPTIVE SIMULATION CARTRIDGE AND METHOD

(71) Applicants: Philip S. Liu, Walnut Creek, CA (US); Chi-Chang Liu, Walnut Creek, CA (US)

(72) Inventors: Philip S. Liu, Walnut Creek, CA (US); Chi-Chang Liu, Walnut Creek, CA (US)

(73) Assignee: Guidance Education Technologies, Inc, Fairfield, CA (US)

( * ) Notice: Subject to any disclaimer, the term of this patent is extended or adjusted under 35 U.S.C. 154(b) by 376 days.

(21) Appl. No.: 16/550,186

(22) Filed: Aug. 24, 2019

(65) Prior Publication Data

US 2020/0141685 A1 May 7, 2020

Related U.S. Application Data

(60) Provisional application No. 62/722,885, filed on Aug. 25, 2018.

(51) Int. Cl.
*F41A 33/02* (2006.01)
*F41A 31/02* (2006.01)

(52) U.S. Cl.
CPC ..... *F41A 33/02* (2013.01); *F41A 31/02* (2013.01)

(58) Field of Classification Search
CPC ..... F41A 33/00; F41A 33/02; F41A 33/04; F41A 33/06; F41G 3/26; F41G 3/2655
See application file for complete search history.

(56) References Cited

U.S. PATENT DOCUMENTS

| | | | | |
|---|---|---|---|---|
| 6,616,452 | B2 | 9/2003 | Clark et al. | |
| 8,584,587 | B2 * | 11/2013 | Uhr | F42B 8/10 102/446 |
| 9,170,079 | B2 | 10/2015 | Moore | |
| 10,209,033 | B1 | 2/2019 | Moore et al. | |
| 10,451,372 | B2 * | 10/2019 | Stetler | F41A 33/00 |
| 2011/0207088 | A1 * | 8/2011 | Uhr | G09B 5/00 434/21 |

* cited by examiner

*Primary Examiner* — Timothy A Musselman

(57) ABSTRACT

A simulation laser training cartridge for dry-firing practice adapts to the wear condition of a given firearm and provides a convenient way of measuring the barrel erosion. The cartridge uses multiple adjustable interfacing parts that can be applied selectively and independently according to the condition of the barrel to ensure a snug fit in 3-dimensions. In a 2-unit kit embodiment of the invention, the muzzle unit can work with multiple chamber units for a multi-chamber firearm. The cartridge also includes internal modules for laser property management, status monitoring, movement tracking, memory, and communication to help a user manage the device and allow for advanced training applications. By changing the laser property, the laser training cartridge can work as a bore sight. The cartridge may further include a means to attach an external part, so the external part comprises a means to distinguish a longitudinal position inside said barrel.

20 Claims, 6 Drawing Sheets

MULTI-FUNCTION ADAPTIVE SIMULATION CARTRIDGE AND METHOD

CROSS REFERENCE TO RELATED APPLICATIONS

This application claims the benefit of provisional application No. 62/722,885, filed Aug. 25, 2018, which application is incorporated herein in its entirety by this reference.

INTRODUCTION

The present disclosure relates to laser dry fire training cartridges, sometimes called simulation cartridges, later trainers, or laser bullets for shooting skill training. (LaserBullets™ is a registered trademark of Guidance Education Technologies Inc. of California, USA.) The construction and method of operation of the present disclosure, however, together with additional objectives and advantages thereof will be best understood from the following description of specific embodiments when read in connection with the accompanying drawings.

Dry firing is the practice of working with an unloaded firearm and practicing all routines and sub-routines that can be done without live fire. The present disclosure relates to the non-explosive firearm training cartridges—simulation cartridges, for shooting skill training. For example, the G-Sight Gen 2 single-caliber Laser Training Cartridge uses a common double O-ring design to fit into the chamber of a firearm. Unlike real ammo, whose projectile path is regulated by the barrel and its internal structure to ensure consistency, laser beam produced from a well-made simulation cartridge largely relies on the physical interface between the cartridge and the firearm bore to ensure a desired bore axis-aligned projection path. Inadequately designed or poorly manufactured simulation cartridges failing to provide a true and consistent simulation of the projectile path offer very limited value to the user. Although the existing double O-ring laser cartridges do allow for the size of the O-rings to be changed to improve the fit to the firearm, the improvement is limited because the positioning of the O-rings are fixed in the longitudinal direction.

Another way to achieve the same simulation functionality is to separate the laser portion from the trigger switch and attach the laser portion to the muzzle of the firearm. In general, chamber-integrated simulation cartridges are simpler in construction, easier to use, and cheaper to make. But they are difficult to maintain alignment, due to the direct impact force on the cartridge from the firing mechanism activated by each trigger pull and a wide range of firearm condition and of the design and manufacturing variations in bore and chamber. In contrast, at the expense of breaking the profile of the firearm, a muzzle-integrated simulation cartridge does not experience the direct impact force on the laser unit from the firing mechanism and deals with a somewhat limited range of design and manufacturing variations. However, as the barrel of an in-service firearm gets worn from repeated firing, a condition called throat erosion starts developing and may affect the interface performance of a chamber-integrated laser cartridge. If left unnoticed, the laser beam of a used-to-work simulation cartridge may start going off alignment and affecting the user training in an unpredictable way. A similar condition, called muzzle erosion, may also develop on the muzzle side of the barrel and starts affecting a muzzle-integrated simulation cartridge in a similar manner.

Information collected from users of the G-Sight Gen 2 Laser Training Cartridges have shown that a training cartridge that was fitting well for a firearm may lose its fitness after the firearm goes through intensive live shooting sessions. Hence, a simulation cartridge that can handle a wide range of variations in bore and chamber design, manufacturing, and wear conditions adaptively and raise user awareness of the present wear condition of the firearm is both desirable and valuable.

SUMMARY

Figure 1:
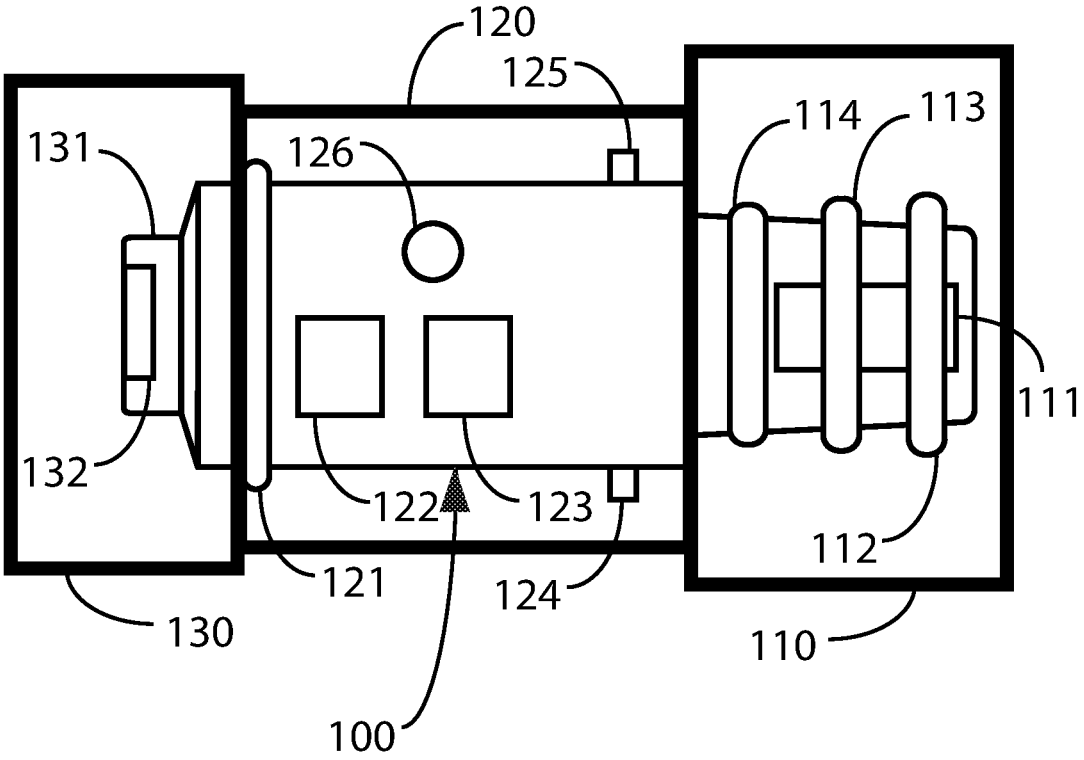
FIG. 1 shows a chamber-integrated simulation laser cartridge

Disclosed herein is a single-caliber simulation laser training cartridge and method for dry-firing practice which adapts to the wear condition of a given firearm and provides a convenient way of measuring the barrel erosion. The cartridge uses multiple adjustable interfacing parts that can be applied selectively and independently according to the condition of the barrel to ensure a snug fit in 3-dimensions. In a 2-unit kit embodiment, the muzzle unit may work with multiple chamber units for a multi-chamber firearm. The cartridge may also include internal modules for laser proper management, status monitoring, movement tracking, memory, and communication to turn it into a bore sight, help user manage the device and allow for advanced training applications.

Some embodiments may have an adaptive laser simulation training cartridge comprising an interfacing feature of a longitudinal length no more than 20 mm to a firearm barrel, wherein said interfacing feature consists at least two independently adjustable circumferential parts, wherein at least one of said adjustable parts is in direct physical contact with said barrel at any time and at least another one of said adjustable parts is not when a pre-determined condition is met. The laser simulation training cartridge may further include a means to attach an external part, so the external part comprises a means to distinguish a longitudinal position inside said barrel.

DETAILED DESCRIPTION

Generality of Invention

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Read this application with the following terms and phrases in their most general form. The general meaning of each of these terms or phrases is illustrative, not in any way limiting.

In FIG. 1, a chamber-integrated single-caliber simulation laser cartridge 100 consists of a trigger section 130, a center section 120, and a front section 110; trigger section 130 and center section 120 have the same envelop diameters and together produce an overall length compatible to that of the shell casing of the corresponding ammunition, not shown in the drawing. In FIG. 1 trigger section 130 has an end section 131 that contains activation switch 132. The diameter of end section 131 is much smaller than the shell casing of the corresponding ammo, not shown in the drawing, to avoid contact with the extractor and the loaded chamber indicator of the designated firearms, not shown in the drawing, so that they will not interfere the positioning of cartridge 100, which maintains a laser path parallel to the longitudinal axis of the barrel throughout training operations. In one embodiment of the present disclosure, center section 120 and trigger section 130 are integrated by screw threading, where trigger section 130 can be removed to allow access to a battery chamber and internal parts and components, all of which not shown in the drawing, inside cartridge 100.

In FIG. 1, a center section 120 uses a communication and controller module 122 to communicate with other compatible devices, such as a mobile device running a training App or a simulation slide assembly, (not shown), when possible, to report its own status and calculated data, coordinate operation, and manage the behavior of cartridge 100, for example. Another function of communication and controller module 122 is to upload its own status and internally calculated data to a cloud server on a set schedule or at will. For example, a data upload will be activated when user manually presses down switch 132 for 2 to 3 seconds. A memory module 123 in center section 120 keeps a copy of relevant information about cartridge 100 and, the firearm and the user, both not shown in the drawing, so that they can be retrieved as needed any time even when the firearm is absent or changed. For example, a typical cartridge may require regular maintenance after each 3000-4000 laser activations. Memory module 123 keeps a running count of the laser shots and warns the user, not shown in the drawing, when the next maintenance schedule is up soon or the end of life of the entire unit, based on the life expectancy of the product, is approaching. Although not shown in the drawing, cartridge 100 may have a status lamp to show the health condition of the cartridge and display special light patterns for special conditions or operation modes.

Alternatively, laser unit 111 may be used to display special light sequences to warn the user, not shown in the drawing, about special conditions. A photo-sensitive component 126 is embedded in center section 120 and exposed to the ambient light without breaking out the outer cylindrical surface of center section 120. Working with a power management circuit, not shown in the drawing, photo-sensitive component 126 helps to determine when to turn the main power of center section 120 on only when the ambient light is below a predetermined level as the cartridge is put in to the chamber of a firearm, not shown in the drawing, and the slide is closed. This smart power switch reduces the energy required to operate cartridge 100 significantly and minimizes the chances laser unit 111 to be activated unintentionally. Utilizing the smart power switch, another function of communication and controller module 122 is to turn the laser cartridge into a bore sight. That is, when user manually presses down switch 132 for 5 seconds communication and controller module 122 will activate the bore sight mode and allow laser 111 to be automatically turned on when the ambient light is below a predetermined level. Another press of switch 132 will terminate the bore sight mode. For a smaller caliber cartridge that has considerably smaller dimensions and internal space, one or more silicon PIN photodiodes, such as the SFH 2700 FA from OSRAM may be used as the photo-sensitive component. In FIG. 1, spring loaded metal taps 124 and 125 are used to draw power from external power source, (not shown), when possible. A rear O-ring 121 made of rubber is placed between center section 120 and trigger section 130 over a groove made by polishing down the screw treading from the inner part surface. Although not shown in the drawing, by rotating section 130 to change the width of the groove between sections 120 and 130, different sizes and shapes of O-rings may be used for O-ring 121 to allow small adjustments of the overall length of cartridge 100 and the head space so as to achieve a snug fit for a wider range of tolerances and conditions of different firearm models and units, not shown in the drawing, that's not possible otherwise.

In one embodiment of the present disclosure, front section 110 is permanently attached to center section 120 and has a diameter slightly smaller than the bullet of the corresponding ammunition, not shown in the drawing. In FIG. 1, front section 110 contains a laser unit 111, a first front O-ring 112, a second front O-ring 113, and a third front O-ring 114; each O-ring has a unique color and is mounted on its designated groove. In one embodiment cartridge 100 is equipped with a nominal size O-ring 112 that has the greatest thickness of the three and producing an effective circumferential diameter about the same as the upper limit of the groove diameter of the designated firearms. O-ring unit 114 has the smallest initial thickness and produces an effective circumferential diameter about the same as the lower limit of the bore diameter of the designated firearms. To allow cartridge 100 to work for a wide range of firearms, of which each model may have a different barrel interior design and each unit a different wear condition, all three O-rings may be replaced by different sizes O-rings but of the same color for easy identification.

Additionally, O-rings 112 and 113 are designed to be removed selectively when necessary to achieve the best possible fit for a given firearm. Because all firearms are subject to throat and muzzle erosions, conditions that will change the barrel interior property and subsequently degrade the fit of a past working laser cartridge. That is, for a new barrel with no throat erosion, not shown in the drawing, applying O-ring 114 with proper size adjustment alone should achieve a perfect fit for cartridge 100. In contrast, for a severely worn barrel, not shown in the drawing, it is likely that O-ring 112 will be applied to achieve the best fit. Although not shown in the drawing, cartridge 100 has a surface marking etched near O-ring 112 to warn the user, not shown in the drawing, that the present barrel, not shown in the drawing, has a sever throat erosion condition if O-ring 112 is in use. Alternatively, the erosion warning may also be served by assigning a special color or texture to O-ring 112 and observing when an O-ring of that color or texture is in use. Although not shown in the drawing, O-rings 112, 113, and 114 may have designed surface grooves or bumps, exterior texture or random protrusions to enhance their performance.

It should be noted, FIG. 1 serves merely as an illustrative embodiment and that the present disclosure is by no means limited to using O-rings as the only means to interface with a barrel. For example, rubber sheath or other suitable interfacing design made of compressible material may also be used to replace some or all of the O-rings. In another embodiment of the present disclosure and not shown in the drawing, trigger section 130 contains a rotary switch, where each orientation may change at least one characteristic of the simulation cartridge. For example, the wavelength of the laser, the pulse duration of the laser, and the pattern of the laser beam, to name a few. In another embodiment of the present disclosure, the outer surface of trigger section 130 is not completely circular to avoid the extractor or loaded chamber indicator of certain firearms, not shown in the drawing, from making contact with the simulation cartridge. Although not shown in the drawing, simulation laser cartridge 100 may contain a gyro to measure the movement and 3D position of the firearm before and during user pulling the trigger. Additionally, simulation laser cartridge 100 may also contain a GPS module so that its location can be accurately identified and tracked.

Figure 1A:
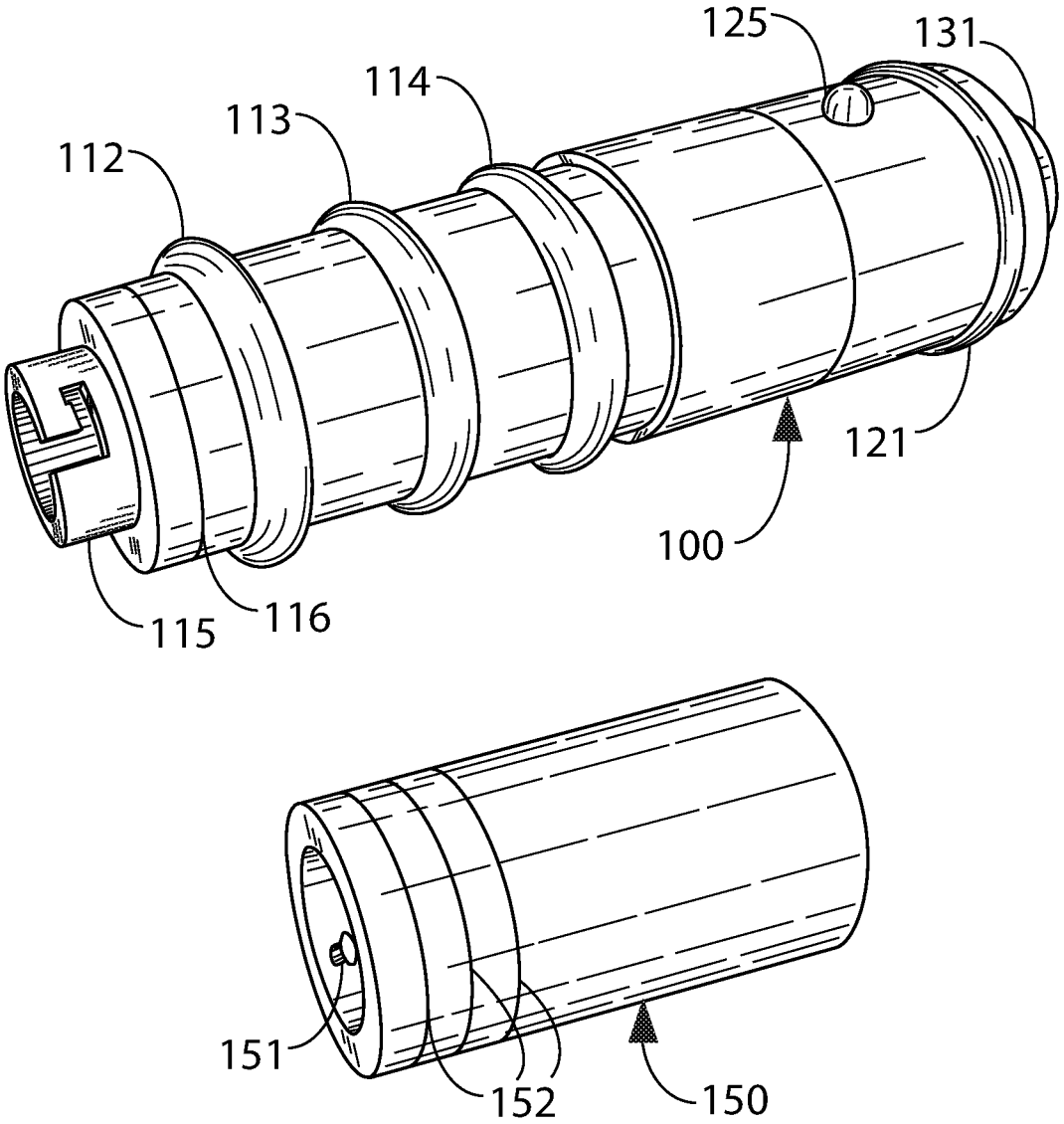
FIG. 1A shows an alternative embodiment of features in FIG. 1.

FIG. 1A shows an alternative embodiment of front section 110 of FIG. 1. In FIG. 1A a bayonet mount mechanism is implemented to join an attachment rod 150 with precision machined outer shape and slowly changed dimensions to cartridge 100. Part 115 of cartridge 100 is the female part of the mount, part 151 of attachment rod 150 is the male part. In FIG. 1A, gradation of diameter changes of attachment rod 150 is designed for measuring the throat erosion of the specific firearms matching the caliber of cartridge 100 with the corresponding markings 152 etched on the surface of rod 150 and 116 on cartridge 100. That is, when attachment rod 150 is securely attached to cartridge 100 and with O-rings 112, 113, and 114 removed, cartridge 100 can be used to measure the throat erosion of a firearm, providing an additional useful function and great convenience to the user.

Figure 2:
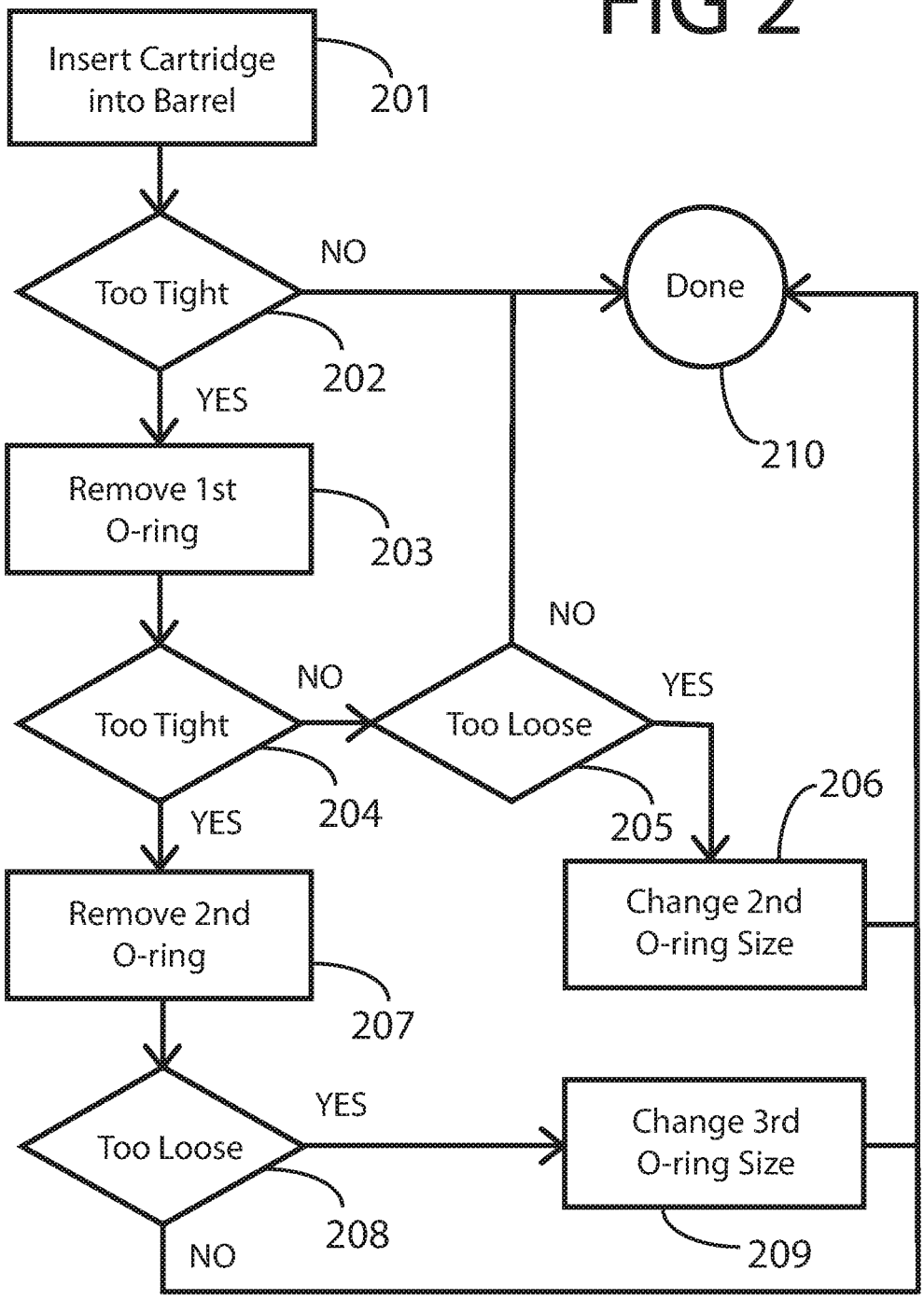
FIG. 2 shows a flowchart of a cartridge installation into a firearm.

FIG. 2 shows the flowchart of cartridge 100 installation into a firearm. In a typical setup, a user starts with block 201 putting the cartridge into the chamber of the firearm, not shown in the drawing, and then pushes the cartridge forward into the barrel, not shown in the drawing. If the cartridge appears to be too tight and won't fit or sit in the barrel properly for the cartridge to function properly, which may happen when the throat erosion of the firearm is not too sever, in block 203 the first O-ring 112, is to be removed. If not, then the cartridge is ready to be used. If the first O-ring 112 is removed, user, not shown in the drawing, is to check the cartridge fit condition again. If the cartridge still appears to be too tight, which happens when the firearm only has a mild or no throat erosion condition, in block 204 the second O-ring 113 is to be removed. If the cartridge appears to be too loose, which happens when the firearm has a minor throat erosion condition, in block 206 the second O-ring 113 is to be replaced by a slightly bigger O-ring. If the second O-ring is removed due to tightness, user, not shown in the drawing, is to check the cartridge fit condition again with the mounted third O-ring 114. If the cartridge appears to be too loose, in block 209 a slightly bigger third O-ring 114 is to be used.

Figure 3:
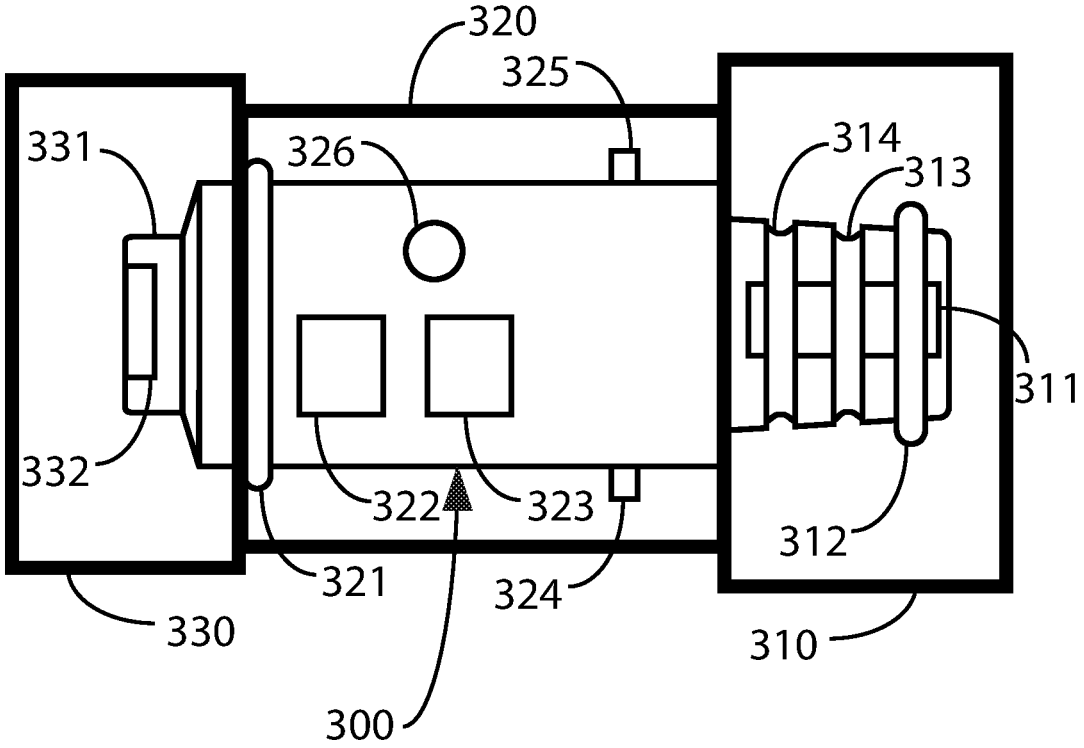
FIG. 3 shows a chamber-integrated simulation laser cartridge.

In FIG. 3, a chamber-integrated single-caliber simulation laser cartridge 300 consists of a trigger section 330, a center section 320, and a front section 310. In FIG. 3, trigger section 330 and center section 320 share the same envelope diameter and together produce an overall length compatible to that of the shell casing of the corresponding ammunition, not shown in the drawing. In FIG. 3 trigger section 330 has an end section 331 that contains activation switch 332. In FIG. 3 end section 331 has an envelope diameter much smaller than the shell casing of the corresponding ammo, not shown in the drawing, to avoid contact with the extractor and the loaded chamber indicators of the designated firearms, not shown in the drawing, thus the positioning of simulation laser cartridge 300 in the firearm, not shown in the drawing, will stay fixed while maintaining a laser path parallel to the barrel's longitudinal axis throughout training operations. In one embodiment of the present disclosure, center section 320 and trigger section 330 are integrated by screw threading, where trigger section 330 can be removed to allow access to a battery chamber and internal parts and components, not shown in the drawing, inside center section 320.

A center section 320 has a communication and controller module 322, which communicates with other compatible devices, such as a mobile device running a training App or a simulation slide assembly, both not shown in the drawing, to report own status and calculated data, coordinate operation, and manage the behavior of cartridge 300, for example. A memory module 323 in center section 320 keeps a copy of relevant information about cartridge 300 and, the firearm and the user, both not shown in the drawing, so that they can be retrieved as needed any time even without the firearm present. A photo-sensitive component 326 helps to determine when to turn the main power of center section 320 on only if the ambient light is below a predetermined level as the cartridge is put inside the chamber of a firearm, not shown in the drawing, and the slide is closed. This smart power switch reduces the energy required to operate cartridge 300 significantly. Utilizing the smart power switch, another function of communication and controller module 322 is to turn the laser cartridge into a bore sight. That is, when user manually presses down switch 332 for 5 seconds communication and controller module 322 will activate the bore sight mode and allow laser 311 to be automatically turned on when the ambient light is below a predetermined level. Another press of switch 332 will terminate the bore sight mode.

In consideration of the limited space available in a smaller caliber cartridge, one or more Silicon PIN Photodiodes, such as the SFH 2700 FA from OSRAM may be used as the photo-sensitive component. Two spring loaded metal taps 324 and 325 in FIG. 3 are used to draw power from an external power source, not shown in the drawing. In FIG. 3 a rear O-Ring 321 is placed between center section 320 and trigger section 330. Although not shown in the drawing, different sizes and shapes of O-rings 321 may be used to increase or decrease the distance between center section 320 and trigger section 330 to achieve fine adjustments of the overall length of the cartridge and, thus, the head space, to a degree, so as to provide better fit for a wider range of tolerances of different firearm models and units, not shown in the drawing. In one embodiment of the present disclosure, front section 310 is permanently attached to center section 320 and has a diameter somewhat smaller than the bullet of the corresponding ammunition, not shown in the drawing.

A front section 310 contains a laser unit 311 and a first front O-ring 312, which is installed over an O-ring groove, not sown in the drawing, and having a diameter between the largest bore diameter and the smallest groove diameter of the designated firearms, not shown in the drawing. Additionally, front section 310 also has a second front O-ring groove 313 and a third front O-ring groove 314, each may hold an O-ring and produce a diameter between the smallest bore diameter and the largest groove diameter of the designated firearms, not shown in the drawing, when an O-ring is installed. Although not shown in the drawing, different sizes, shapes and textured O-rings may be used for some of the three O-rings to provide a snug fit to a wide range of firearm models and of different conditions. For example, almost all firearms are subject to throat and muzzle erosions, conditions that will change the barrel interior property and subsequently degrades the fit of a past working laser cartridge. In this embodiment, for a new barrel, not shown in the drawing, O-ring 312 will prohibit cartridge 300 to go into the barrel far enough for a proper fir. And, therefore, may need to be removed and apply O-ring 314, for example. As the throat erosion develops, user may change O-ring 314 to a smaller size. And, if necessary, O-ring 313 must be applied. As the throat erosion gets greater, the same process may be applied again, if necessary, so that the best O-ring is installed on groove 312 to provide the best possible fit. Although not shown in the drawing, cartridge 300 has a surface marking etched near O-ring 312 to warn the user, not shown in the drawing, that the present barrel, not shown in the drawing, has a sever throat erosion condition if O-ring 312 must be applied.

The present disclosure is by no means limited to using O-rings as the only interface means to the barrel of a firearm. For example, rubber sheath or similar property material with proper interfacing design may also be used to replace some or all the O-rings. In another embodiment of the present disclosure, trigger section 330 contains a rotary switch, where each position may cause certain characteristics of the simulation cartridge to change. For example, the wavelength of the laser, the pulse duration of the laser, and the pattern of the laser may be changed, to name a few. In another embodiment of the present disclosure, the outer surface of trigger section 330 is not completely circular like the shell of the real ammo, not shown in the drawing, to be replaced, to avoid any part of cartridge 300 making contact with the extractor or loaded chamber indicator of a firearm, not shown in the drawing. Although not shown in the drawing, simulation laser cartridge 300 may contain a gyro to measure the 3D movement of the firearm before and during user pulling the trigger. Additionally, simulation laser cartridge 300 may also contain a GPS module so that its location can be accurately identified and tracked.

Figure 4:
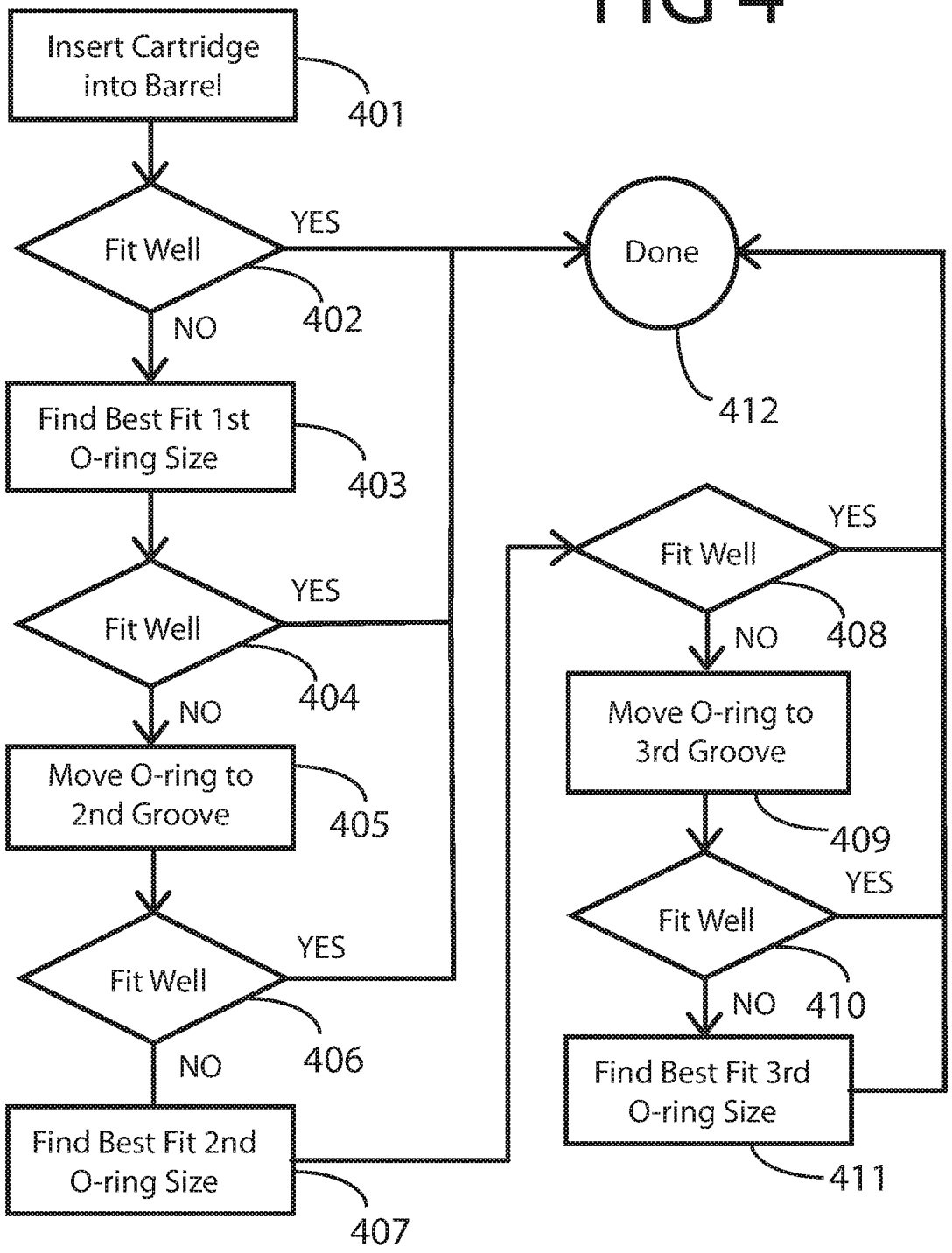
FIG. 4 shows a flowchart of cartridge installation into a firearm.

FIG. 4 shows the flowchart of cartridge installation into a firearm. In a typical setup, user, not shown in the drawing, starts with block 401 putting the cartridge into the chamber of the firearm, and push the cartridge forward into the barrel. If the cartridge appears to be too tight and won't fit properly, which may happen when the throat erosion of the firearm is not too sever, in block 403 the first O-ring 312 is adjusted to the best fitting size. If not, then the cartridge is ready to be used. If the best fitting O-ring 312 doesn't offer the desired fit, O-ring 312 is removed, and the starter O-ring used for 312 is put on groove 313. A user, is to check the cartridge fit condition again. If the cartridge still appears to be too tight, which happens when the firearm only has a very limited or no throat erosion condition, in block 404 the O-ring in groove 131 is to be adjusted for best possible fit. If the cartridge appears to be too loose, which happens when the firearm has a minor throat erosion condition, in block 406 the second O-ring is to be replaced by a slightly bigger O-ring. If the second O-ring is removed due to tightness, user, not shown in the drawing, is to check the cartridge fit condition again with the starter O-ring installed on groove 314. If the cartridge fitting is not adequate, in block 409 O-ring 314 is adjusted to the best possible fit.

Figure 5:
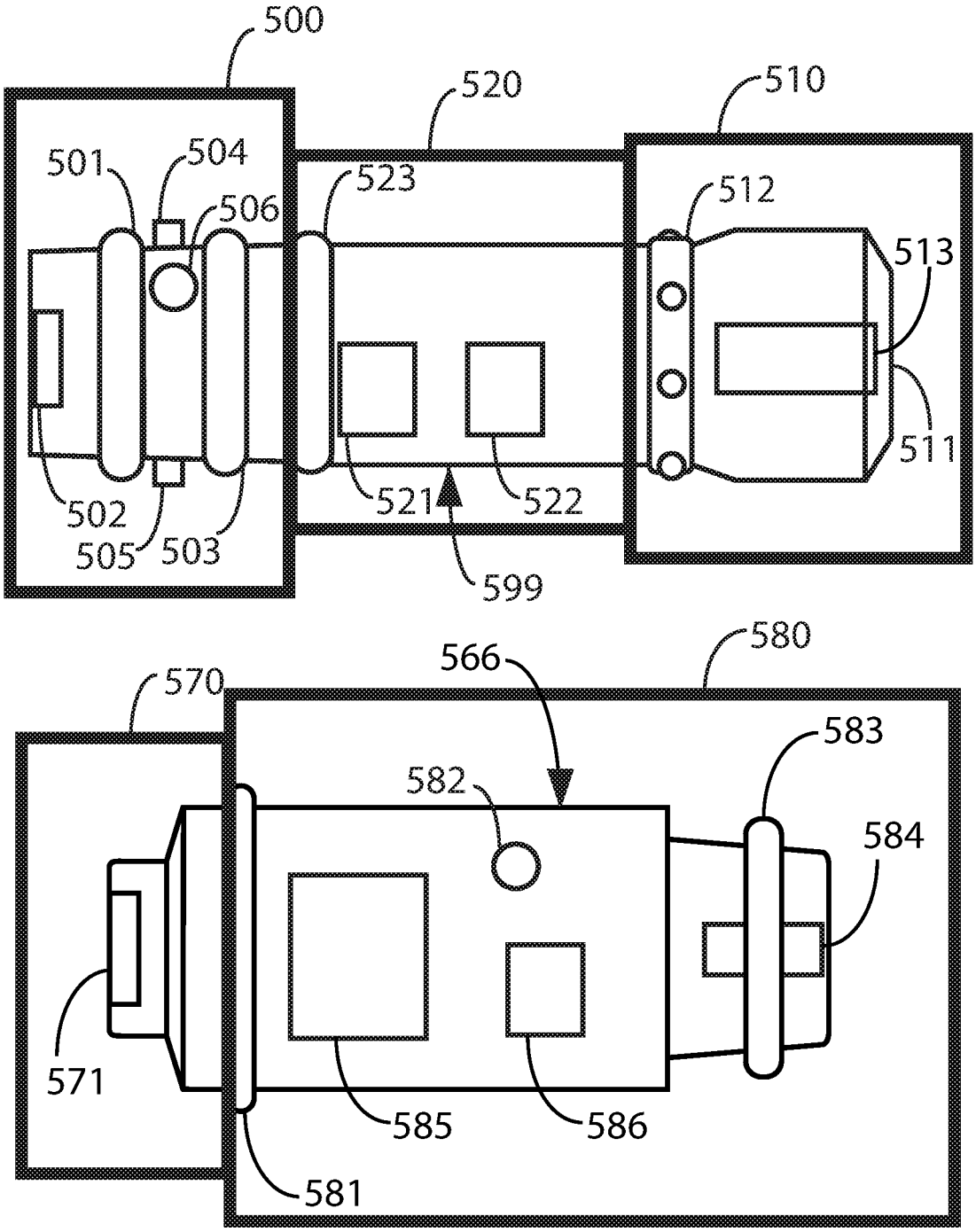
FIG. 5 shows a simulation laser kit with a muzzle-integrated laser unit and a chamber unit.

In FIG. 5, a simulation single-caliber laser kit consists of a muzzle-integrated laser unit 599 and a chamber unit 566. Laser unit 599 consists of a rear section 500, a center section 520, and a front section 510. In FIG. 5, rear section 500 has a slightly tapered cylinder shape with maximum diameters slightly smaller than the barrel of the firearm, not shown in the drawing. In FIG. 5, rear section 500, which is designed to be inserted into a barrel, not shown in the drawing, contains O-ring 501, O-ring 503, and a light-sensitive switch 502 that may be triggered by a dark-to-bright light intensity transition initiated by chamber unit 566.

Power to the light-sensitive switch 502 is managed by a communication and controller module 521 utilizing a photoresistor 506, which is to be positioned inside the barrel, not shown in the drawing, during normal operation. When laser unit 599 is not in use and placed outside of a barrel, not shown in the drawing, photoresistor 506 is likely to be exposed to a normal room-level ambient light, communication and controller module 521 disables the function of light-sensitive switch 502 and laser 513 by cutting off the power to both parts. When laser unit 599 is inserted into a barrel, not shown in the drawing, photoresistor 506 is shielded from the ambient light and exposed to an extremely low light level which enables communication and controller module 521 to supply power to all parts of laser unit 599, including light-sensitive switch 502 and laser 513. Under such laser-enabled condition, laser 513 initiates a laser signal when light-sensitive switch 502 senses a rapid light rise-up to a certain level from a dark condition. This design offers a higher level of safety of laser operation while reducing the waste of energy when laser unit 599 is not in operation.

Depending on the mode setting in communication and controller module 521, laser 513 may send out a short laser pulse, a sequence of laser pulses or a long laser pulse, for example. In FIG. 5, rear section 500 also includes two spring loaded metal contacts 504 and 505, which allow power from an external power source, not shown in the drawing, to be drawn when possible. In one embodiment of the present disclosure, center section 520 and rear section 500 are integrated by screw threading, where rear section 500 can be removed to access a battery chamber and internal parts and components, not shown in the drawing, inside center section 520.

A rear O-ring 523 is placed between center section 520 and rear section 500 to serve 2 main purposes: (1) to allow the length of laser unit 599 to be adjusted to a certain level, and (2) to allow the fitting to a barrel, not shown in the drawing, to be maximized. As almost all firearms are subject to muzzle erosion, a condition that will change the barrel interior property and subsequently degrade the fit of a past working simulation cartridge, a three-O-ring interface consisting O-ring 523, O-ring 501, and O-ring 503 provide a solution. For a new barrel, not shown in the drawing, where muzzle erosion is absent, front O-ring 512 and O-ring 523 may offer a perfect fit of laser unit 599 to the barrel of most firearms and both O-ring 512 and O-ring 501 are to be removed. For the unfit firearms, user may apply an O-ring 523 of different thickness or dimension to achieve the best fit. As the barrel goes through real ammo shooting and develops throat erosion, thickness and dimension adjustments of O-ring 523 can no longer handle the deviation, O-ring 503 must be applied so that O-ring 512 will not be too far off from its nominal position—close to the muzzle opening. As the throat erosion gets sever, O-ring 501 must be applied. Although not shown in the drawing, laser unit 599 has a surface marking etched near O-ring 501 location to warn the user that the present barrel, not shown in the drawing, may have a sever muzzle erosion condition when O-ring 501 is in use. Although not shown in the drawing, O-ring 523, O-ring 501, and O-ring 523 may have surface groves, exterior texture or small protrusions to enhance their performance.

The present disclosure is not limited to using O-rings as the only means to interface with the barrel. For example, rubber sheath or similar property material with proper interfacing design may also be used to replace any or all the O-rings. In FIG. 5, front section 510 has a diameter slightly smaller than the bullet of the corresponding ammunition, not shown in the drawing, and is permanently attached to center section 520. In FIG. 5, front section 510 contains a laser 513, a laser aperture 511, and front O-ring 512, which has small surface bumps for easier operation. Although not shown in the drawing, front section 510 may contain an antenna module for wireless communication. Front section 510 may also contain a gyro to measure the movement of the firearm before and during user pulling the trigger.

Additionally, front section 510 may also contain a high-resolution GPS module so that the location of laser unit 599 can be accurately identified and tracked with precision. Although not shown in the drawing, an external lens may be attached to laser aperture 511 to change the standard laser beam into a specific beam shape of pattern, thus allowing several individually identifiable laser units to be used in the same session. In FIG. 5, communication and controller module 521 also communicates with other devices, such as a mobile App, not shown in the drawing, to report own status and measured data, coordinate operation, and manage the behavior of laser unit 599, for example. A memory module 522 in center section 520 keeps a copy of relevant information on laser unit 599 so that they can be retrieved as needed as a later time. In another embodiment of the present disclosure and not shown in the drawing, rear section 500 can be rotated like a rotary switch, where each position produces a different characteristic of laser. For example, the wavelength of the laser, not shown in the drawing, may be different, the laser pulse duration may be different, and the pattern of the laser, not shown in the drawing, may be different, to name a few. In FIG. 5, chamber unit 566 consists 2 separable sections 570 and 580, which are integrated by screw threading to allow access to a battery compartment and internal parts and components, all of which not shown in the drawing, of section 580. An O-ring 581 is placed between section 570 and section 580. Although not shown in the drawing, different thickness, size and shape of O-rings may be used for O-ring 581 to increase or decrease the distance between section 570 and section 580 and achieve fine adjustments of the overall length of chamber unit 566 and provide better fit for a wider range of tolerances of different firearm models and units.

Section 580 also includes a pressure switch 582 that is activated by a hammer or a striker of a firearm, a power source 585, a memory and control module 586, a front O-ring 583, and a high intensity lamp 584, such as the MV9102 10 mm LED Lamp by Fairchild Semiconductor. Each time switch 582 is activated, it activates lamp 584 for a specific time period. Although not shown in the drawing, section 580 also contains a wireless communication module, which allows memory and control module 586 to communicate with other compatible devices, such as laser unit 599, and to be reprogrammed to behave in different ways. For example, depending on the firearm model and the training activity, memory and control module 560 may be reprogrammed to limit the number of lamp activation per minute. Additionally, depending on the number of shots already fired, memory and control module 560 may disable the lamp activation momentarily or permanently.

Although FIG. 5 shows a simulation laser kit with one laser unit 599 and one chamber unit 566, a laser unit 599 may work with multiple chamber units at the same time. For example, for a revolver handgun, each cylinder chamber may have a chamber unit but the revolver only has one laser unit 599 placed in the barrel, not shown in the drawing. In FIG. 5, section 580 also consists a photoresistor 582, which is to be positioned inside the barrel, not shown in the drawing, during normal operation. Photoresistor 582 in chamber unit 566 works in a similar fashion as photoresistor 506 in laser unit 599 to improve the efficiency of the power use and the safety operation of the device. Although not shown in the drawing, modification to rear section 500 of laser unit 599 in a manner similar to part 115 in FIG. 1A and an attachment rod like 150 in FIG. 1A may be implement for muzzle erosion measurement of the designated firearms. Thus, provides an additional useful function and convenience to the user.

What is claimed is:

1. An adaptive single-caliber laser simulation training cartridge comprising an interfacing feature of a longitudinal length no more than 20 mm to a firearm barrel, wherein said interfacing feature consists at least two independently adjustable circumferential parts, wherein at least one of said adjustable parts is in direct physical contact with said barrel at any time and at least another one of said adjustable parts is not when a pre-determined condition is met.

2. In claim 1, wherein said laser simulation training cartridge further comprises a means to attach an external part, wherein said external part comprises a means to distinguish a longitudinal position inside said barrel.

3. In claim 1, wherein said laser simulation training cartridge further comprises a means to transmit data wirelessly.

4. In claim 1, wherein said laser simulation training cartridge further comprises at least one of a light sensing module and a memory module.

5. In claim 1, wherein at least one of said adjustable parts is adjustable in at least one of diameter, size, width, volume, color, texture, and material.

6. In claim 1, wherein said laser simulation training cartridge further comprises a means to change the property of a laser projection on a surface.

7. In claim 6, wherein said laser simulation training cartridge further comprises a means to restore the property of said laser projection.

8. In claim 1, In claim 1, wherein said laser simulation training cartridge further comprises a means to adjust its longitudinal length.

9. In claim 1, wherein said laser simulation training cartridge further comprises a means to adjust its longitudinal length.

10. A single-caliber adaptive laser training cartridge kit consisting a muzzle unit and a chamber unit, wherein said muzzle unit comprises an interfacing feature of a longitudinal length no more than 20 mm to a firearm barrel, wherein said interfacing feature consists at least two independently adjustable circumferential parts, wherein at least one of said adjustable parts is in direct physical contact with said barrel at any time and at least another one of said adjustable parts is not when a pre-determined condition is met.

11. In claim 10, wherein said chamber unit consists a means to produce light.

12. In claim 10, wherein said chamber unit consists a means to sense light.

13. In claim 10, wherein said training cartridge kit further consists a means to transmit data wirelessly.

14. In claim 10, wherein said muzzle unit consists a means to attach an external part, wherein said external part comprises a means to distinguish a longitudinal position inside said barrel.

15. In claim 10, wherein said muzzle unit consists a means to change the property of a laser projection on a surface.

16. In claim 10, wherein said muzzle unit works with at least two of said chamber unit in a firearm.

17. In claim 10, wherein at least one of said adjustable parts is adjustable in at least one of diameter, size, width, volume, color, texture, and material.

18. In claim 10, wherein at least one of said user adjustable parts is an O-ring.

19. A method for applying an adaptive laser training cartridge consisting an interfacing feature to a barrel of a firearm comprising the steps of:

(a) inserting said training cartridge into a barrel of a firearm;

(b) adjusting a first adjustable circumferential interfacing part when a pre-determined condition is met, wherein step (b) includes:

(b.1) removing said cartridge from said barrel and adjusting said first adjustable circumferential interfacing part; and (b.2) inserting said training cartridge into said barrel; and (c) removing said first adjustable circumferential interfacing part and activating a second circumferential interfacing part when a pre-determined condition is met, wherein step (c) includes:

(c.1) removing said cartridge from said barrel and removing said first adjustable circumferential interfacing part; and (c.2) installing and adjusting a second adjustable circumferential interfacing part, wherein step (c.2) includes:

(c.2.1) installing a second adjustable circumferential interfacing part on said cartridge;

(c.2.2) inserting said training cartridge into said barrel; and (c.2.3) adjusting said second adjustable circumferential interfacing part when a pre-determined condition is met, wherein step (c.2.3) includes:

(c.2.3.1) removing said cartridge from said barrel;

(c.2.3.2) adjusting said second adjustable circumferential interfacing part; and (c.2.3.3) inserting said training cartridge into said barrel;

wherein said interfacing feature consists at least two independently adjustable circumferential parts positioned within a total distance no more than 20 mm in the longitudinal direction of said training cartridge.

20. The method of claim 19, wherein said method further comprising the steps of:

(d) removing said second adjustable circumferential interfacing part and activating a third circumferential interfacing part when a pre-determined condition is met, wherein step (d) includes:

(d.1) removing said cartridge from said barrel and removing said second adjustable circumferential interfacing part; and (d.2) installing and adjusting a third adjustable circumferential interfacing part, wherein step (d.2) includes:

(d.2.1) installing a third adjustable circumferential interfacing part on said cartridge;

(d.2.2) inserting said training cartridge into said barrel; and (d.2.3) adjusting said third adjustable circumferential interfacing part when a pre-determined condition is met, wherein step (d.2.3) includes:

(d.2.3.1) removing said cartridge from said barrel;

(d.2.3.2) adjusting said third adjustable circumferential interfacing part; and (d.2.3.3) inserting said training cartridge into said barrel.

* * * * *